US012091961B2

(12) United States Patent
Ejim

(10) Patent No.: US 12,091,961 B2
(45) Date of Patent: Sep. 17, 2024

(54) METHODS AND SYSTEMS FOR A DOWNHOLE SAND LEVEL DEVICE

(71) Applicant: SAUDI ARABIAN OIL COMPANY, Dhahran (SA)

(72) Inventor: Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 104 days.

(21) Appl. No.: 18/046,332

(22) Filed: Oct. 13, 2022

(65) Prior Publication Data

US 2024/0125226 A1 Apr. 18, 2024

(51) Int. Cl.
*E21B 47/008* (2012.01)
*E21B 43/12* (2006.01)
*E21B 47/12* (2012.01)

(52) U.S. Cl.
CPC ..... *E21B 47/008* (2020.05); *E21B 43/121* (2013.01); *E21B 47/12* (2013.01)

(58) Field of Classification Search
CPC ..... E21B 47/008; E21B 43/121; E21B 47/12
See application file for complete search history.

(56) References Cited

U.S. PATENT DOCUMENTS

2017/0321533 A1* 11/2017 Burnette ..... G01F 1/74
2020/0399965 A1* 12/2020 Fossli ..... E21B 43/36

FOREIGN PATENT DOCUMENTS

JP 2000145349 A * 5/2000

* cited by examiner

*Primary Examiner* — Crystal J Lee
(74) *Attorney, Agent, or Firm* — Osha Bergman Watanabe & Burton LLP

(57) ABSTRACT

A well site includes a wellbore extending from a surface to a target reservoir. A production tubing extends into the wellbore from the surface. The production tubing forms a flow conduit from the target reservoir to the surface. A pump is coupled to the production tubing to lift well fluids to the surface. A sand level device is coupled below the pump. The level device includes one or more transmitters to generate and transmit at least two signals down the wellbore and one or more receivers to receive the at least two signals reflected from a reflecting surface in the wellbore. A time duration of transmitting and receiving the at least two signals may correspond to a straight-line distance between the sand level device and the reflecting surface in the wellbore. The sand level device is configured to send an alarm when the straight-line distance does not surpass a predetermined threshold.

20 Claims, 9 Drawing Sheets

METHODS AND SYSTEMS FOR A DOWNHOLE SAND LEVEL DEVICE

BACKGROUND

In the oil and gas industry, operations may be performed in a well at various depths below the surface with downhole tools. For example, fluids are typically produced from a reservoir in a formation by drilling a wellbore into the formation, establishing a flow path between the reservoir and the wellbore, and conveying the fluids from the reservoir to the surface through the wellbore. Typically, a production tubing is disposed in the wellbore to carry the fluids to the surface. The production tubing may include a pump to assist in lifting the fluids up the wellbore. Fluids produced from a hydrocarbon reservoir may include natural gas, oil, and water.

Various artificial lift systems may be used in the oil and gas industry to increase fluid production and recovery from wells that lack sufficient internal pressure for natural production. These artificial lift systems, based on their lifting mechanisms, may be grouped as mechanical (sucker rod or beam pump, progressing cavity pump, hydraulic piston pump), hydraulic (velocity string, gas lift, plunger lift, jet pump), electromechanical (electric submersible pump, electric submersible progressing pump), and chemical (surfactant, soap sticks). An electrical submersible pump (ESP) generally includes a centrifugal pump, a motor, an electrical power cable connected to the motor, and surface controls (switchboards/variable speed drives). The centrifugal pump, the seal chamber, and the motor are usually hung on tubing or pipe known as a production tubing string from a wellhead with the pump located axially above the motor; however, in certain applications, the motor may be located above the pump.

Conventionally, various artificial lift systems may be frequently used in wells with high sand concentrations. Over a long production period, a cumulative effect of high sand concentrations in the wellbore may result in sand accumulation or a sand cake in the wellbore. Depending on the duration of the production period and sand concentration, the sand level may partially plug the wellbore or may reach a tubing string (e.g., bottom hole assembly (BHA)). Either situation can lead to unexpected remedial action or workover costs which increase non-productive time (NPT) in addition to possible equipment damage, hazardous work environment, and total well loss.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a well site having a wellbore extending from a well site surface to a target reservoir. A production tubing extends into the wellbore from the well site surface. The production tubing forms a flow conduit from the target reservoir to the well site surface. A packer may be disposed in the production tubing. A bottomhole assembly may be disposed below the packer and coupled to the production tubing. The bottomhole assembly may include a pump that may be coupled to the production tubing to lift well fluids to the surface. A sand level device configured to detect sand below the bottomhole assembly is coupled below the pump. The sand level device may include one or more transmitters to generate and transmit at least two signals down the wellbore and one or more receivers to receive the at least two signals reflected from a reflecting surface in the wellbore. A time duration of transmitting and receiving the at least two signals may correspond to a straight-line distance between the sand level device and the reflecting surface in the wellbore. The sand level device may be configured to send an alarm when the straight-line distance does not surpass a predetermined threshold.

In another aspect, the embodiments disclosed herein relate to a method. The method may include pumping well fluids, with a pump, up a production tubing from a wellbore to a surface; transmitting, with one or more transmitters of a sand level device, at least two signals down the wellbore; reflecting the at least two signals off a wall in the wellbore; receiving the at least two signals, with one or more receivers of the sand level device; determining a straight-line distance from the sand level device to the wall in the wellbore based on a time duration of transmitting and receiving the at least two signals; and comparing the determined straight-line distance to a predetermined threshold. When the determined straight-line distance does not surpass the predetermined threshold, the method also may include sending an alarm indicating that a sand level accumulation in the wellbore has reached a maximum level; and conducting remedial operations to reduce the sand level accumulation.

In yet another aspect, the embodiments disclosed herein relate to a non-transitory computer readable medium storing instructions on a memory coupled to a processor. The instructions may include functionality for transmitting, with one or more transmitters of a sand level device, at least two signals down a wellbore; reflecting the at least two signals off a surface in the wellbore; and receiving the at least two signals, with one or more receivers of the sand level device. The processor may be configured to determining a straight-line distance from the sand level device to the surface in the wellbore based on a time duration of transmitting and receiving the at least two signals; and comparing the determined straight-line distance to a predetermined threshold.

Other aspects and advantages will be apparent from the following description and the appended claims.

BRIEF DESCRIPTION OF DRAWINGS

Embodiments of the present disclosure will now be described in detail with reference to the accompanying Figures. Like elements in the various figures may be denoted by like reference numerals for consistency.

DETAILED DESCRIPTION

Figure 1:
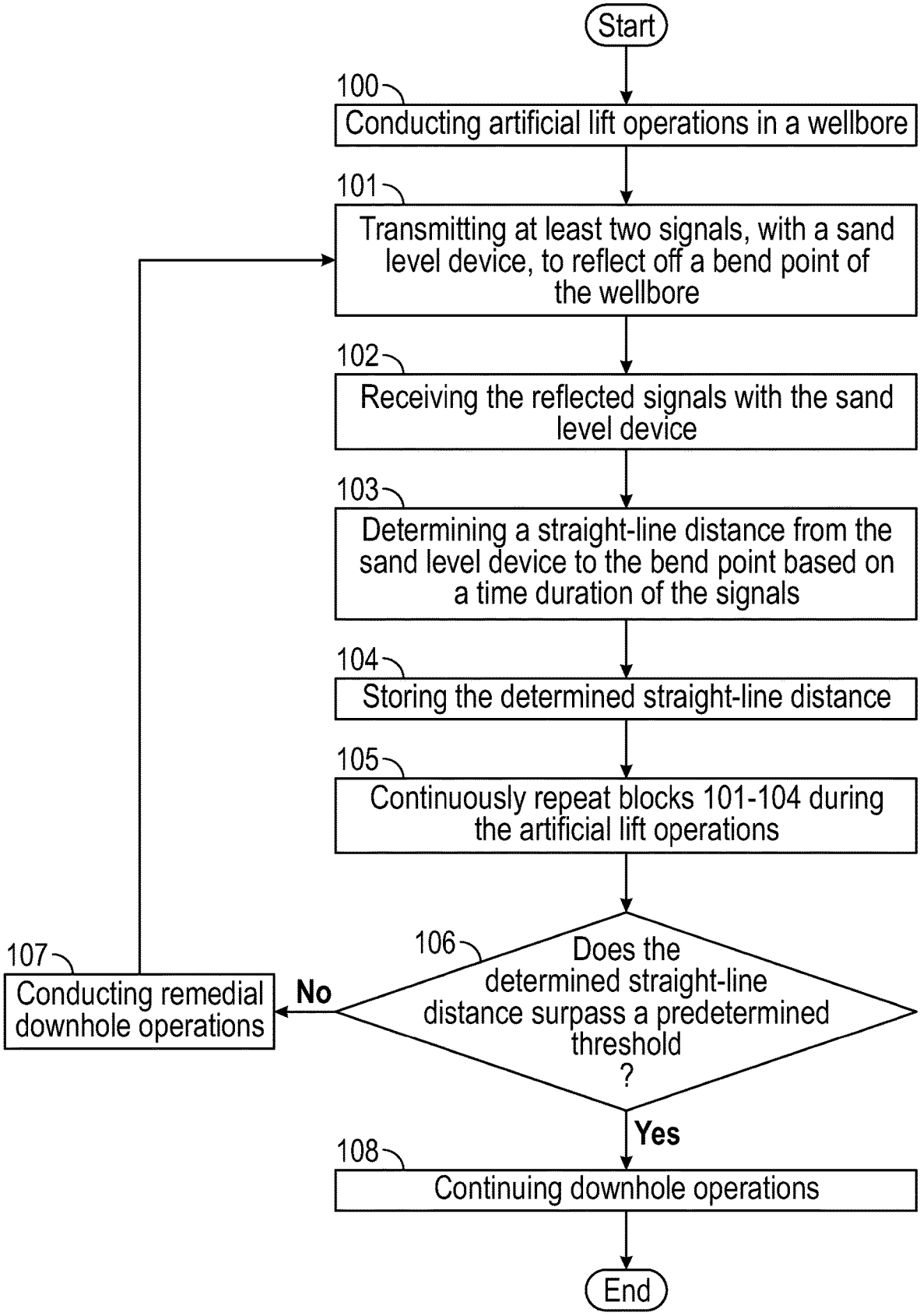
FIG. 1 illustrates a flowchart in accordance with one or more embodiments

In the following detailed description of embodiments of the present disclosure, numerous specific details are set forth to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" "attached" or "attached to" may indicate establishing either a direct or indirect connection and is not limited to either unless expressly referenced as such. Wherever possible, like or identical reference numerals are used in the figures to identify common or the same elements. The figures are not necessarily to scale, and certain features and certain views of the figures may be shown exaggerated in scale for purposes of clarification. In addition, any terms designating tubular (i.e., a length of pipe that provides a conduit for flow therein) should not be deemed to limit the scope of the disclosure. The embodiments are described merely as examples of useful applications, which are not limited to any specific details of the embodiments herein.

Embodiments disclosed herein relate generally to determining a level of sand in a wellbore during operations. More specifically, embodiments disclosed herein relate to systems and methods for a sand level device incorporated into an artificial lift system which is lowered into a wellbore. In one aspect, the sand level device disclosed herein may detect, receive, and transmit data to a surface via the artificial lift system. Overall, the sand level device may provide warnings of a sand level encroaching towards a pump of the artificial lift system to facilitate planned preparation for either sand treatment or unplugging or dissolving operations or other required remedial actions in the well.

FIG. 1 is a flowchart showing a method for determining a level of sand in a wellbore during operations. One or more blocks in FIG. 1 may be performed by one or more components (e.g., a computing system coupled to a controller in communication with devices at a well site). For example, a non-transitory computer readable medium may store instructions on a memory coupled to a processor such that the instructions include functionality for determining the level of sand in the wellbore during operations. While the various blocks in FIG. 1 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 100, artificial lift operations are conducted in a wellbore. For example, a pump, such as an electric submersible pump (ESP) or a progressing cavity pump (PCP), pump well fluids from a wellbore up a production tubing to the surface. During an initial production period, the well fluids are able to carry sand particles into the pump to be pumped to surface via the production tubing. In some cases, the sand particles are moved from a horizontal section of the wellbore to a vertical section of the wellbore to enter the pump.

In Block 101, a sand level device, coupled to the pump, transmits at least two signals down the wellbore to reflect off a bend point or kick-off point in the wellbore. For example, one or more transmitters of the sand level device generates and transmits the at least two signals, such as an electromagnetic or acoustic signal, that is sent down the wellbore. Each signal of the at least two signals may be transmitted down the wellbore at different angles to cover various points along the entire diameter of the wellbore. The bend point or kick-off point may be an area where the wellbore transitions from the vertical section to the horizontal section. Additionally, the sand level device may be positioned at an end of the production tubing closest to a bottom of the wellbore such that a depth of the sand level device is known, and no other downhole equipment interferes with the transmitted signals to reflect off the bend point or kick-off point. Further, the transmitted signals may be encoded with a time stamp indicating a time at which the at least two signals were transmitted from the sand level device.

In Block 102, the reflected signals are received by the sand level device. For example, one or more receivers of the sand level device receives the reflected signals. Additionally, the received reflected signals may be time stamped to indicate a time at which the reflected signals were received by the sand level device.

In Block 103, a straight-line distance from the sand level device to the bend point or kick-off point is determined based on time duration of the signals transmitted to received (i.e., time of flight of the signal). For example, a processor of the sand level device may compute the straight-line distance and/or the sand level device may transmit the measurements to a controller at the surface for processing. In some embodiments, the straight-line distance may be computed by multiplying a known velocity at which the signals were transmitted with the time of flight of the signals and dividing the multiplication by two. Additionally, the straight-line distance corresponds to a sand level within the wellbore. For example, an initial determined straight-line distance may correspond to no sand accumulation in the bend point or kick-off point. In the case where addition determined straight-line distance are shorter than the initial determined straight-line distance, this means that sand has begun to accumulate as the time of flight of the signal will be shorter (i.e., the transmitted signals reflect faster).

In Block 104, the determined straight-line distance is stored. For example, a memory of the sand level device may store the determined straight-line distance and/or the controller at the surface may store the determined straight-line distance. In some embodiments, the initial determined straight-line distance may be stored as a control value equating to no sand accumulation in the bend point or kick-off point.

In Block 105, the Blocks 101-104 are continuously repeated as the artificial lift operations are continued. By continuously repeating the Blocks 101-104, an accumulation of sand in the bend point or kick-off point may be determined. Additionally, data from the sand level device may be continuously transmitted from the wellbore to surface. At the surface, the data may be relayed to a controller, such as, a computer system in a surveillance room at an operator facility. By having continuous transmission, the method ensures effective monitoring and quick reaction time to cater to encroaching sand levels in the wellbore.

In the Block 106, the determined straight-line distance is compared to predetermined thresholds. For example, the predetermined threshold of a straight-line distance may be a value equal to when the determined straight-line distance corresponds to a maximum sand level allowed in the wellbore. The maximum sand level may equate to a sand level that will reach downhole equipment. If the determined straight-line distance does not surpass the predetermined threshold, the sand accumulation has progressed to reach the maximum sand level which corresponds to a shorter straight-line distance. With the maximum sand level reached, the method moves to the Block 107. However, if the determined straight-line distance does surpass the predetermined threshold, the sand accumulation has not progressed to reach the maximum sand level and downhole operations to be conducted as shown in Block 108. For example, the downhole operations may be to continue the artificial lift operations for producing hydrocarbons.

In Block 107, with the maximum sand level reached, remedial downhole operations are conducted. For Example, chemical treatments may be pumped down the production tubing and through the pump or other downhole equipment to reach the wellbore below. The chemical treatments may then start to dissolve the sand accumulation. As the remedial downhole operations are conducted, the method may repeat Blocks 101-106 to continuously measure how much sand accumulation has been dissolved until the determined straight-line distance does surpass the predetermined threshold.

Overall, the method for determining the level of sand in the wellbore during operations, as described in FIG. 1, enables improved and early detection of sand encroaching downhole equipment. Additionally, the method increases efficiency of planning well or equipment remedial action and reduces costs associated with pre-mature and unplanned equipment failure or well plug-up from sand accumulation.

Now referring to FIGS. 2-6, in one or more embodiments, FIGS. 2-6 illustrate a system of implementing the method described in the flowchart of FIG. 1 at a well site 200. The well site 200 may produce hydrocarbons using an artificial lift system 201 in a wellbore 203. The wellbore 203, which is connected to a surface, may be drilled through subterranean formations to reach to a target reservoir 204. In some embodiments, the wellbore 203 may be perforated to have perforations 205 into the target reservoir 204 to allow a flow of hydrocarbons to enter the wellbore 203. The well site 200 may also include a production tubing 206 extending into the wellbore 203 from a wellhead at the surface. The production tubing 206 forms a flow conduit from the target reservoir 204 to the surface.

In one or more embodiments, the target reservoir 204 may be isolated by one or more packers 208 sealing an annulus between the production tubing 206 and the wellbore 203. Additionally, the one or more packers 208 provides isolation or acts as a pressure barrier between well fluids below the one or more packers 208 and any fluids above the one or more packers 208. Once the target reservoir 204 is isolated, the artificial lift system 201 may be operated, increase the pressure of the fluids, and discharge the pressurized fluids into the production tubing 206. Pressurized fluid in the production tubing 206 rises to the surface due to differences in pressure.

At an end of the production tubing 206, a bottomhole assembly 207 may be provided with various downhole tools, such as the artificial lift system 201 to retrieve fluids from the target reservoir 204. The artificial lift system 201 may include of a pump 209, a protector 210, a cable 211, a motor 212, a monitoring sub/tool 213, and an intake port 214. Fluid enters the artificial lift system 201 through the intake port 214. The pump 209 is used to lift well fluids to the surface or if at surface, transfers fluid from one location to another. The pump 209 may be an electric submersible pump (ESP) or a progressing cavity pump (PCP) or any type of downhole pump for lifting fluids. The motor 212 provides mechanical power required to drive the pump 209 via a shaft. The cable 211 provides a means of supplying the motor 212 with the needed electrical power from the surface. The protector 210 absorbs a thrust load from the pump 209, transmits power from the motor 212 to the pump 209, equalizes pressure, provides/receives additional motor oil as temperature changes and prevents well fluid from entering the motor 212.

In operation, the pump 209 of the artificial lift system 201 consists of stages, which are made up of impellers and diffusers. The impeller, which is rotating, adds energy to the fluid to provide head, whereas the diffuser, which is stationary, converts the kinetic energy of fluid from the impeller into head. The pump 209 stages are typically stacked in series to form a multi-stage system that is contained within a pump housing. The sum of head generated by each individual stage is summative; hence, the total head developed by the multi-stage system increases linearly from the first to the last stage. The monitoring sub/tool 213 is installed onto the motor 212 to measure parameters such as pump intake and discharge pressures, motor oil and winding temperature as well as motor vibration. Measured downhole data is communicated to surface via the cable 211.

In one or more embodiments, a sand level device 202 is incorporated into the artificial lift system 201. For example, the sand level device 202 may be positioned at a bottom of the artificial lift system 201. The bottom of the artificial lift system 201 may also be the lowermost position of the bottomhole assembly 207. The lowermost position of the bottomhole assembly 207 may be predetermined and recorded at the surface so that a setting depth at which the sand level device 202 sits in the wellbore 203 is known. In some embodiments, the sand level device 202 may be directly coupled to the monitoring sub/tool 213 or incorporated within the monitoring sub/tool 213. The sand level device 202 receives operating power, such as electrical power, from the cable 211 electrically connected to the monitoring sub/tool 213 and electrically coupling to the sand level device 202. Additionally, the sand level device 202 sends data through the monitoring sub/tool 213 and up the cable 211 to surface.

The sand level device 202 includes one or more transmitters 215 and one or more receivers 216. The one or more transmitters 215 and the one or more receivers 216 may be operationally (i.e., electrically) coupled to the cable 211 to send and receive data from the surface. Further, the one or more transmitters 215 and the one or more receivers 216 may be electromagnetic or acoustic such that the received signals are easily ascertained from reflection of signals from a surface of the wellbore 203.

Figure 2:
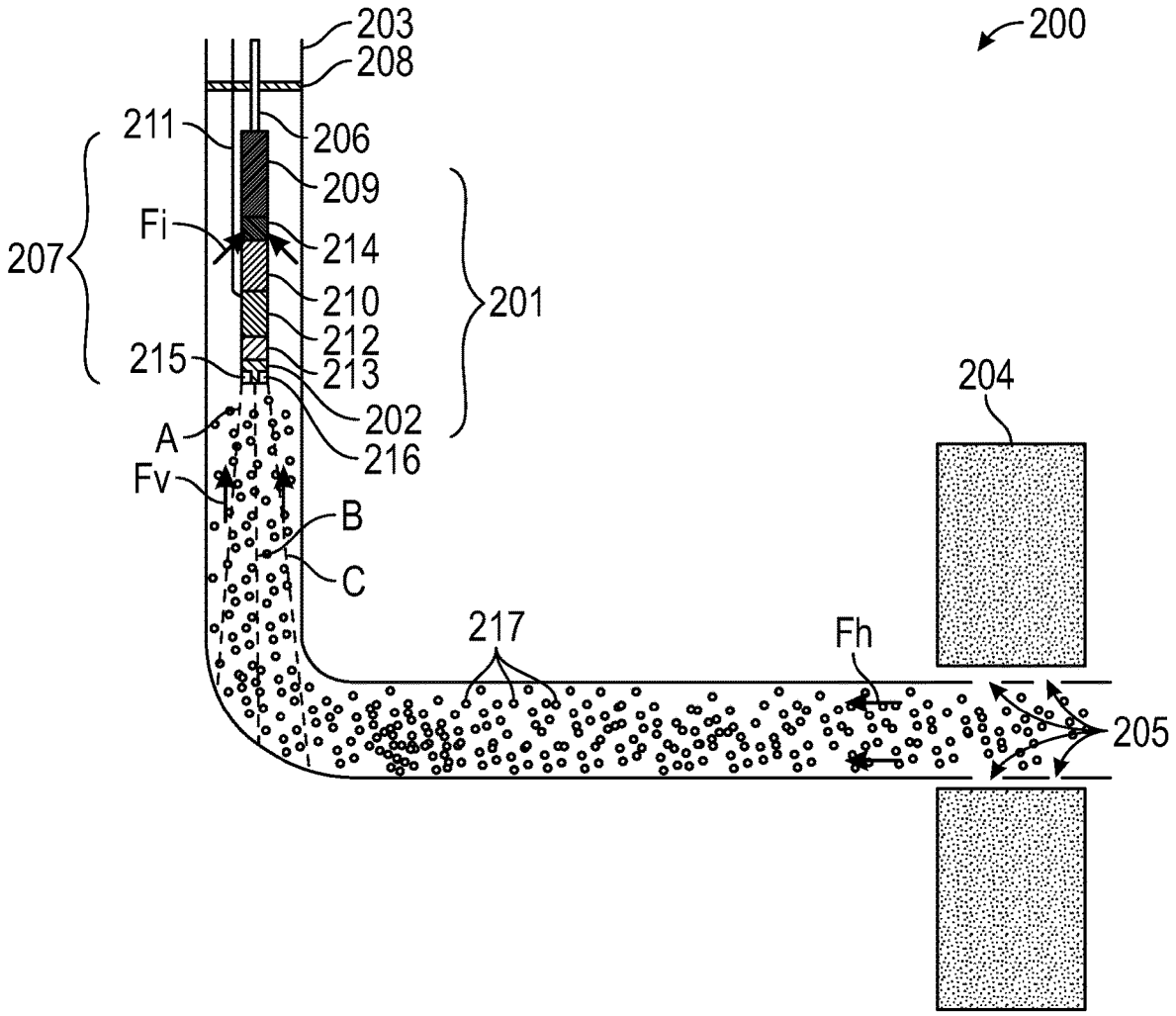
FIGS. 2-6 show examples of implementing the method of FIG. 1 in accordance with one or more embodiments of the present disclosure.

In FIG. 2, in one or more embodiments, an initial production period is illustrated. In an artificial lift operation, the pump 209 is operated to increase the pressure in the wellbore 203. The increased pressure causes well fluids, such as hydrocarbons from the target reservoir 204, to flow (Arrow Fh) in a horizontal section of the wellbore 203 and up (Arrow Fv) a vertical section of the wellbore 203 to enter (Arrow Fi) the intake port 214. From the intake port 214, the well fluids may be pumped to surface via the production tubing 206.

In one or more embodiments, sand particles 217 are also carried by the well fluids from the horizontal section of the wellbore 203 up the vertical section of the wellbore 203 into the intake port 214, where the sand particles 217 are pumped to surface via the production tubing 206. As shown in the production scenario of FIG. 2, sand accumulation has not yet commenced in the wellbore 203 and the sand particles 217 are still freely flowing with the well fluids.

Still referring to FIG. 2, in operation, the one or more transmitters 215 of the sand level device 202 transmits at least two signals (A, B, C). For illustrations purposes only, three signals (A, B, C) are shown being transmitted; however, any number of signals greater than one signal may be transmitted from the one or more transmitters 215 of the sand level device 202. In some embodiments, the number of signals generated and transmitted by the one or more transmitters 215 may be based on a coverage needed to cover a cross-section of the wellbore 203. For example, a first signal A, a second signal B, and a third signal C may be transmitted at different angles and directions from each other to reflect on different points along an inner wall of the wellbore 203 to cover the full cross-section of the wellbore 203.

In one or more embodiments, the straight-line distance from the sand level device 202 to different portions of a bend or kick-off point may be computed based on time duration of the at least two signals (A, B, C) reflected to the one or more receivers 216 of the sand level device 202. The bend or kick-off point may be a transition section of the wellbore 203 where the wellbore 203 deviates from the vertical section to the horizontal section. Additionally, as the setting depth of the sand level device 202 and the depth of the bend or kick-off point of the wellbore 203 is known, a predetermined threshold may be correlated. Further, the straight-line distance from FIG. 2 correlates to an initial determined straight-line distance as the at least two signals (A, B, C) are reflecting off the bend or kick-off point of the wellbore 203 with no sand accumulation occurring.

Figure 3:
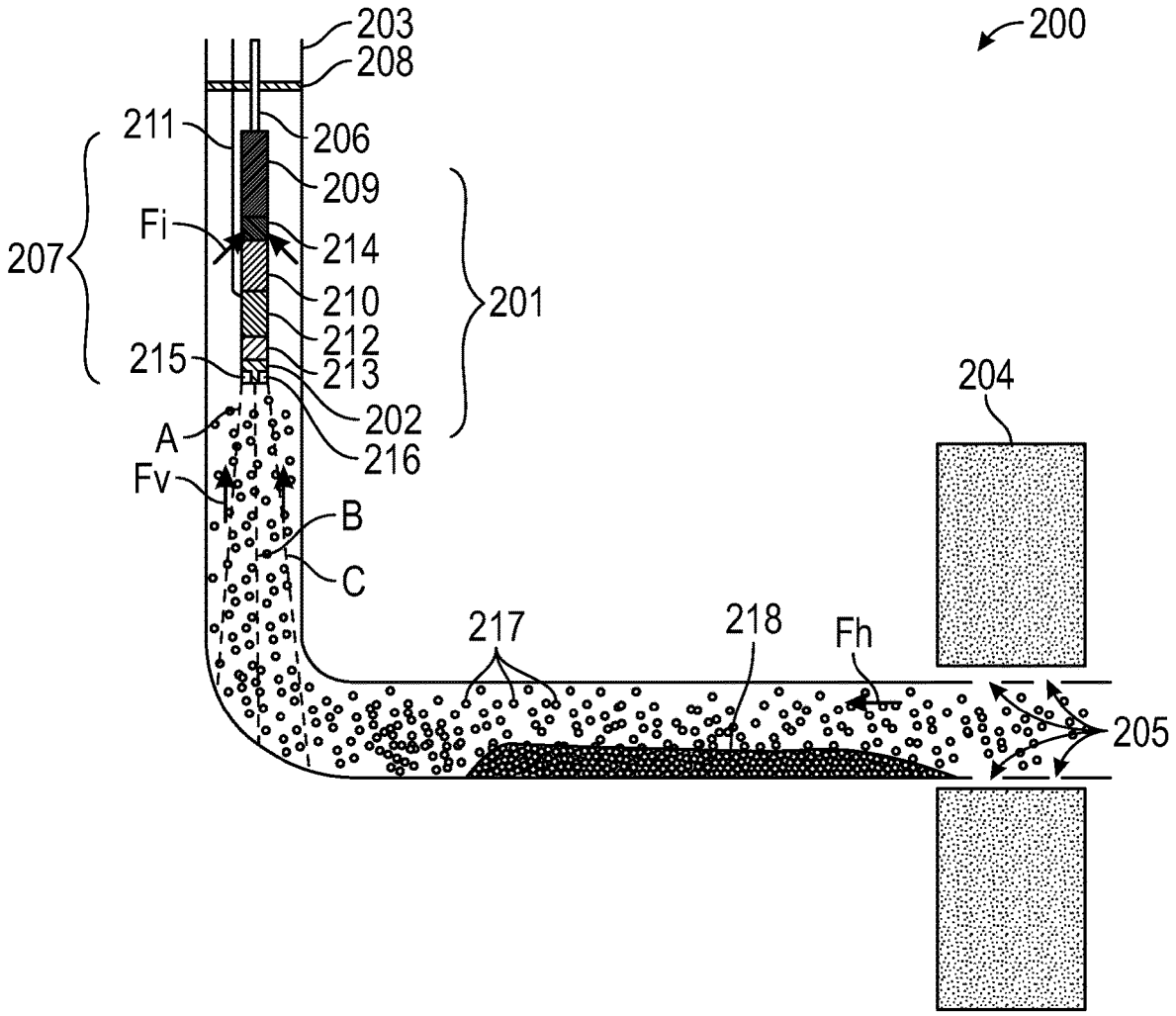

In FIG. 3, as artificial lift operations continue, sand may begin to build up in the wellbore 203 after a period of production time. For example, a sand accumulation 218 may begin to form in the horizontal section of the wellbore 203. The sand accumulation 218 may be interchangeably referred to as a sand cake or mud cake. The sand accumulation 218 may be formed by the sand particles 217 permeating into the wellbore 203 instead of flowing with the well fluids. The permeation of the sand particles 217 to form the sand accumulation 218 may be caused by several variables such as well fluid properties, downhole pressure, downhole temperature, formation permeability, formation porosity, flow rates, and time.

Over time, the sand accumulation 218 may increase in size to disrupt production (i.e., the flow of well fluids to the surface) and damage the various components of the artificial lift system 201. To prevent the sand accumulation 218 from encroaching the artificial lift system 201, the sand level device 202 is continuously operated to provide continuous sand level monitoring in the wellbore 203. As shown in FIG. 3, the sand level device 202 is still transmitting and receiving the at least two signals (A, B, C) as artificial lift operations continue from FIG. 2. In the scenario depicted in FIG. 3, the duration of transmitting and receiving the at least two signals (A, B, C) is still the same as the duration of transmitting and receiving the at least two signals (A, B, C) in FIG. 2. As the duration of transmitting and receiving the at least two signals (A, B, C) has not changed, this indicates the sand accumulation 218 or any of the sand particles 217 has not permeated in the bend or kick-off point of the wellbore 203.

Figure 4:
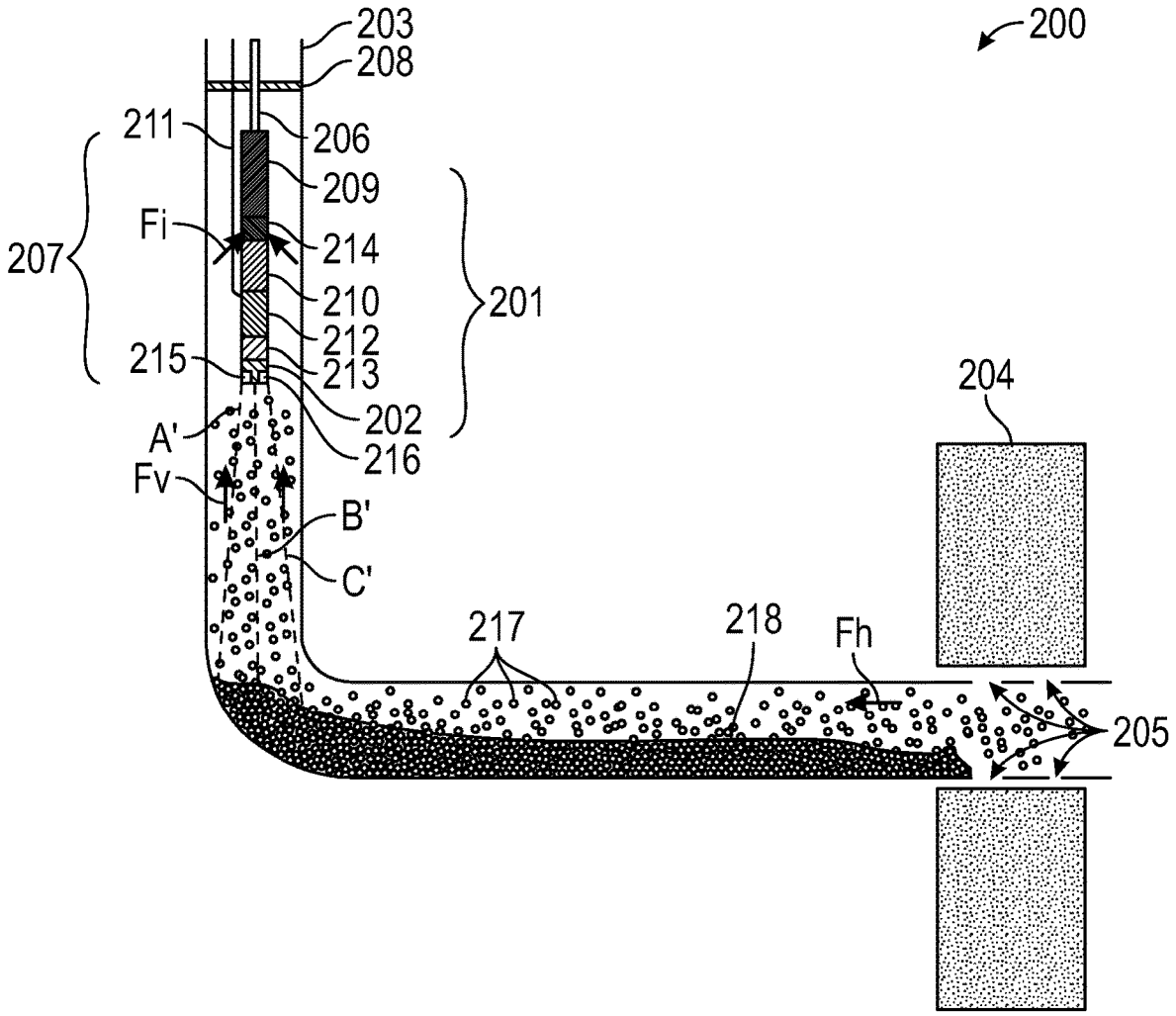

Now referring to FIG. 4, as artificial lift operations continue and with continuous sand level monitoring, the scenario depicts an increase in the size of the sand accumulation 218. For example, the sand accumulation 218 has now further permeated to start encroaching into the vertical section of the wellbore 203.

In one or more embodiments, the at least two signals (A', B', C') transmitted and received by the sand level device 202 are now reflected off the sand accumulation 218 instead of the wellbore 203. In this condition, due to the presence of the sand cake in the bend or kick-off point of the wellbore 203, the duration time between transmitting and receiving the at least two signals (A', B', C') is now shorter compared to the duration time between transmitting and receiving the at least two signals (A, B, C) in FIGS. 2 and 3. The shorter time duration corresponds to a shorter straight-line distance than the initial determined straight-line distance, thereby indicating that the at least two signals (A', B', C') are no longer reflecting off the wellbore 203. As shown in FIG. 4, the shorter straight-line distance confirms that the at least two signals (A', B', C') are reflecting off the sand accumulation 218 and the sand accumulation 218 has grown to now be encroaching into the vertical section of the wellbore 203.

Figure 5:
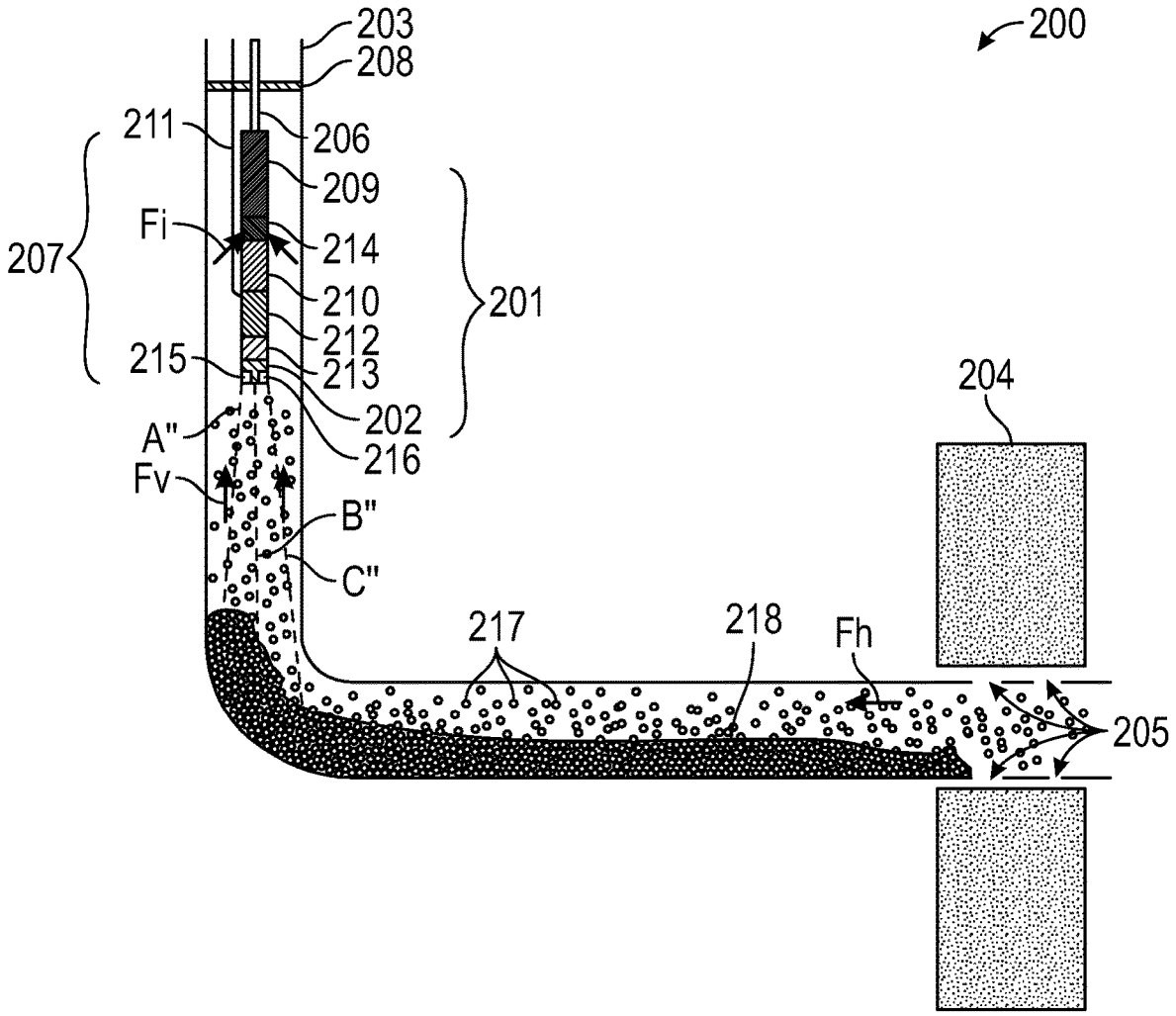

As the sand accumulation 218 continues to permeate, the sand accumulation 218 can begin to cake in the vertical section of the wellbore 203, as depicted in the scenario of FIG. 5. As the sand level device 202 is continuously monitoring the sand level, the at least two signals (A", B", C") transmitted and received by the sand level device 202 are now reflected off the sand accumulation 218 in the vertical section of the wellbore 203. In this condition, due to the presence of the sand cake in the vertical section of the wellbore 203, the duration time between transmitting and receiving the at least two signals (A", B", C") is now shorter compared to the duration time between transmitting and receiving the at least two signals (A', B', C') in FIG. 4. The shorter time duration of FIG. 5 corresponds to a shorter straight-line distance than the previous determined straight-line distance of FIG. 4. As shown in FIG. 5, the shorter straight-line distance confirms that the at least two signals (A", B", C") are reflecting off the sand accumulation 218 in the vertical section of the wellbore 203.

As shown from FIG. 3 to FIG. 5, the sand accumulation 218 progresses to permeate further up the wellbore 203 which corresponds to a shorter straight-line distance from a top of the sand accumulation 218 to the sand level device 202. The sand level device 202 is continuously recording and transmitting to the surface such that the sand accumulation 218 in the wellbore 203 is monitored in real-time. The sand level device 202 will continuously transmit and receive the at least two signals (A, A', A", B, B', B", C, C', C") until a maximum sand level of the sand accumulation 218 is reached. The maximum sand level may be predetermined by an operator. For example, the maximum sand level may correspond to a sand level that provides enough time for remedial actions to be taken for reducing a sand level of the sand accumulation 218 from contacting the artificial lift system 201 or disrupting the flow of well fluids to the surface.

Figure 6:
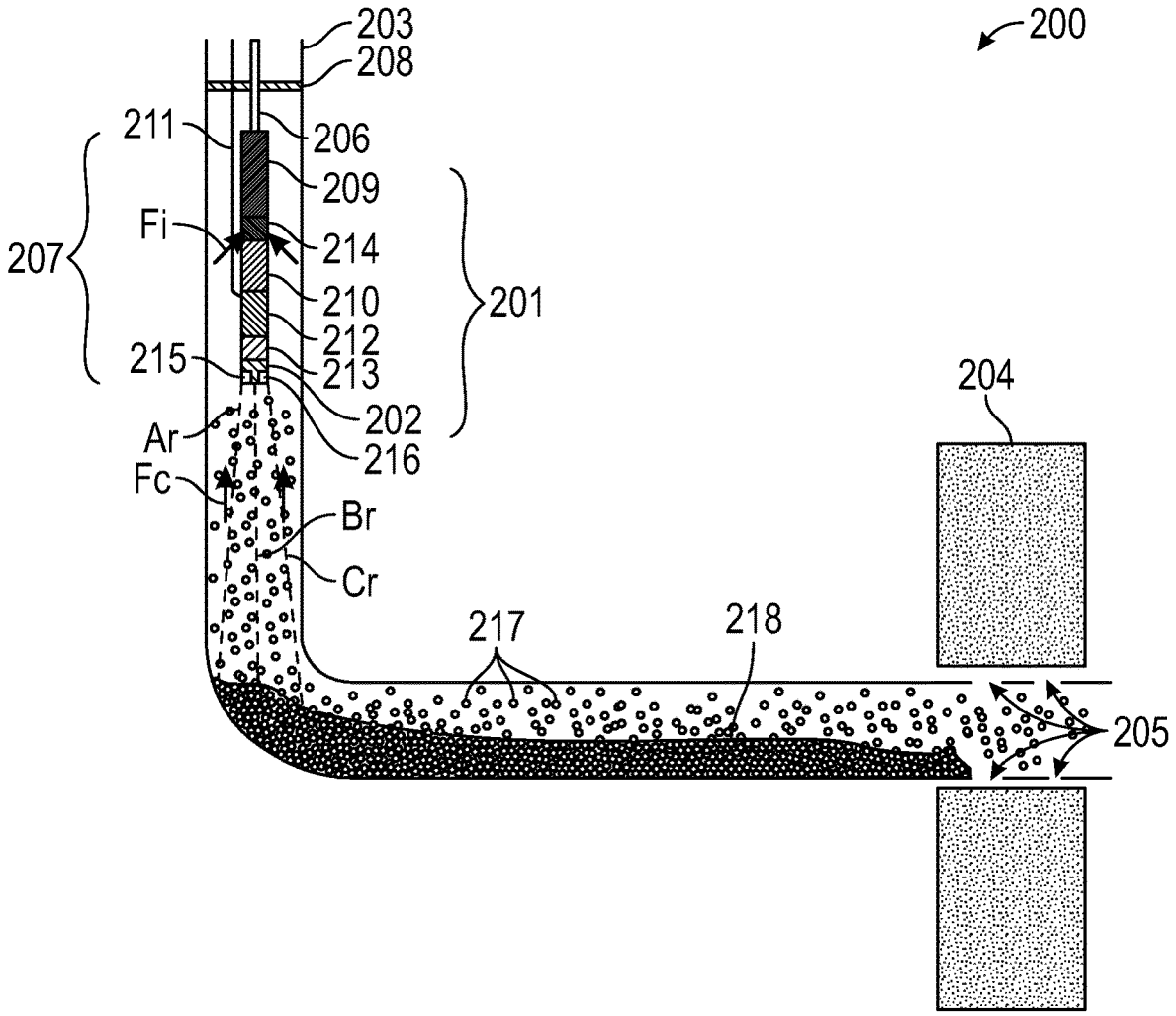

Once the maximum sand level is reached, the sand level device 202 may send an alarm or alert to an operator. As shown in FIG. 6, after receiving the alarm or alert, remedial actions may be conducted to reduce the sand level of the sand accumulation 218. For example, the remedial actions may be chemical treatments to dissolve the sand accumulation 218. In the remedial actions, chemically treated fluids, such as bullheading chemicals, may be pumped down the production tubing 206 and flow (see Arrow Fc) down the wellbore 203 to contact the sand accumulation 218. Upon contacting the sand accumulation 218, the chemically treated fluids begin to dissolve the sand accumulation 218 such that the sand level is reduced. In some embodiments, the pump 209 may be attached to a branched section of a Y-tool (not shown) such that the chemically treated fluids may be implemented by running through a straight section of the Y-tool and to the sand accumulation 218.

During the remedial actions, the sand level device 202 continuously transmits and receives at least two signals (Ar, Br, Cr) to provide real-time measurements of the sand accumulation 218 being chemically dissolved. As the sand accumulation 218 dissolves, a duration time between transmitting and receiving the at least two signals (Ar, Br, Cr) is now longer compared to the duration time between transmitting and receiving the at least two signals (A", B", C") in FIG. 5. The longer time duration corresponds to a longer straight-line distance than the determined straight-line distance of the maximum sand level, thereby indicating that the sand accumulation 218 is no longer at the maximum sand level. As shown in FIG. 6, the longer straight-line distance confirms that the at least two signals (Ar, Br, Cr) are reflecting off the dissolved sand accumulation 218 which is no longer encroaching into the vertical section of the wellbore 203. It is further envisioned that the sand level device 202 send an alert to the operator once the duration time between transmitting and receiving the at least two signals (Ar, Br, Cr) reaches a predetermined length. The predetermined length corresponds to a sand level of the sand accumulation 218 that is no longer in the vertical section of the wellbore 203. Once the alert is sent, the remedial actions may be stopped and production of well fluid may start again, or other downhole operations may be conducted.

Figure 7A:
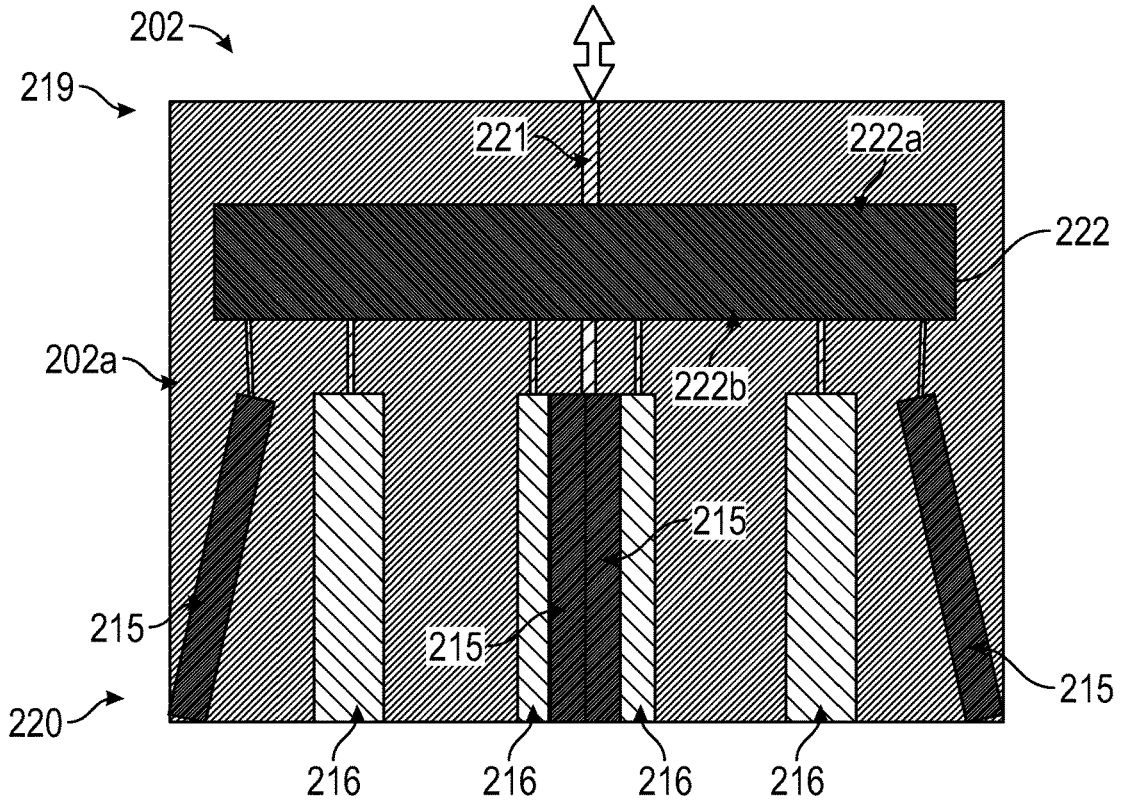
FIGS. 7A-8 illustrate cross-sectional views of a sand level device in accordance with one or more embodiments of the present disclosure.

Now referring to FIG. 7A, in one or more embodiments, a cross-sectional view of the sand level device 202 is illustrated. The sand level device 202 includes a body 202*a* extending from a first end 219 to a second end 220. At the first end 219, the sand level device 202 may include an electrical connection 221 to electronically connect to the monitoring sub/tool (213). At an end distal to the monitoring sub/tool (213), the electrical connection 221 is connected to an electronic board 222 in the body 202*a*. For example, the electrical connection 221 is connected to a top surface 222*a* of the electronic board 222.

In one or more embodiments, the one or more transmitters 215 and the one or more receivers 216 are connected to the electronic board 222. For example, the one or more transmitters 215 and the one or more receivers 216 are connected to a bottom surface 222*b* of the electronic board 222 opposite the top surface 222*a*. From the electronic board 222, the one or more transmitters 215 and the one or more receivers 216 extend to the second end 220. By extending to the second end 220, the one or more transmitters 215 and the one or more receivers 216 may send and receive signals without interruptions. Additionally, the one or more transmitters 215 and the one or more receivers 216 may be axially spaced from each other to cover more area.

Figure 7B:
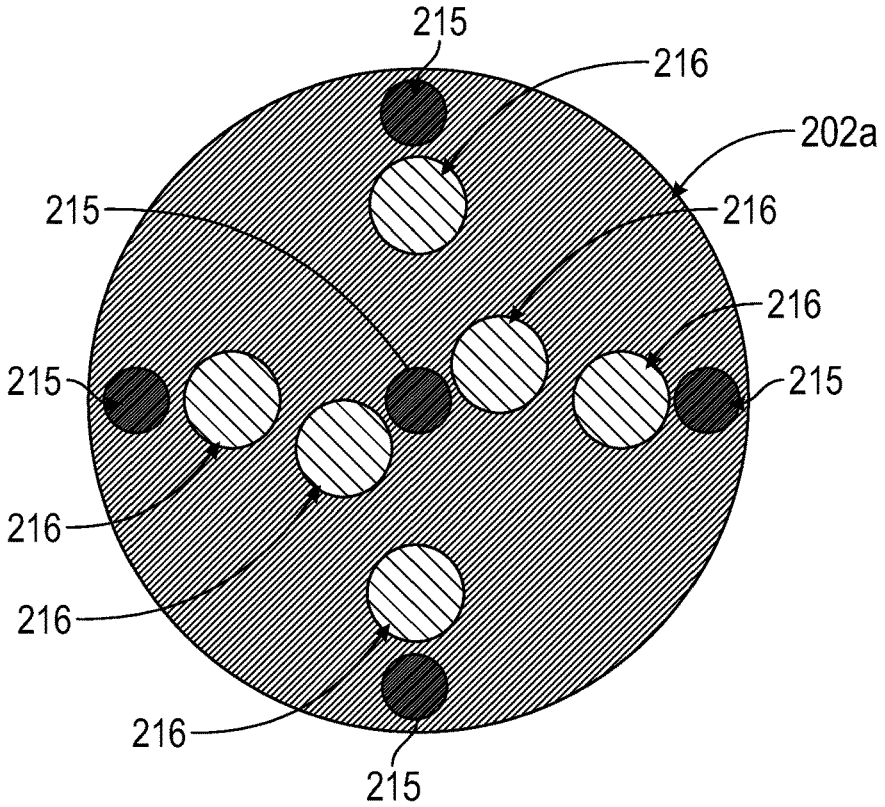

Now referring to FIG. 7B, a bottom view of the body 202*a* from FIG. 7A is illustrated. The one or more transmitters 215 and the one or more receivers 216 may be radially spaced from each to other to cover more area in the wellbore (203).

Figure 8:
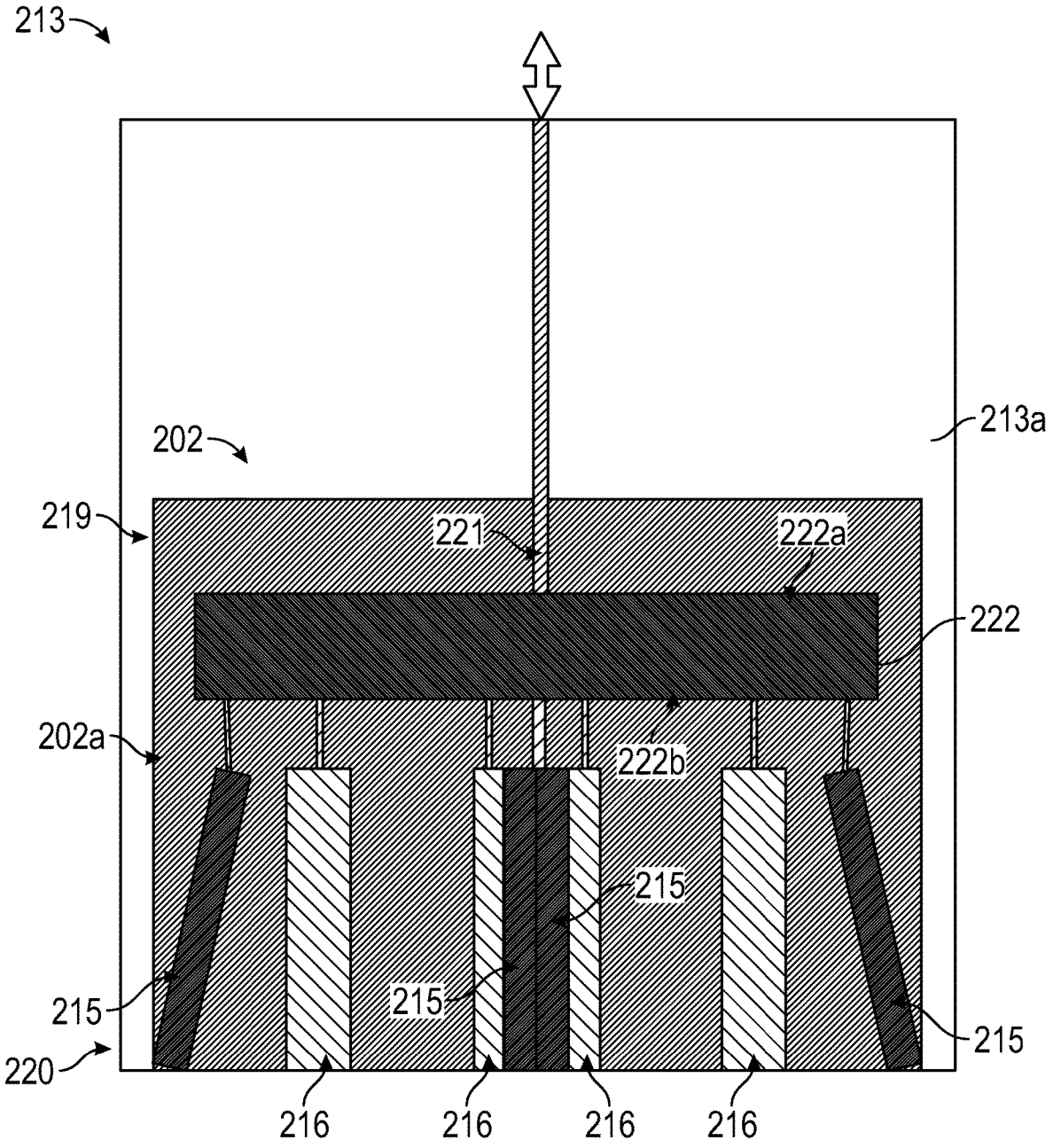

Referring now to FIG. 8, another embodiment of the sand level device 202 according to embodiments herein is illustrated, where like numerals represent like parts. The embodiment of FIG. 8 is similar to that of the embodiment of FIG. 7A. However, the body 202*a* of the sand level device 202 is within a frame 213*a* of the monitoring sub/tool 213. Additionally, the electrical connection 221 travels through the frame 213*a* to connect to the body 202*a*.

In case of sand accumulation in a wellbore, according to embodiments herein, a method and system for utilizing a sand level device attached to an artificial lift system is operated to continuously measure, monitor, and transmit the sand accumulation in the wellbore. By using the sand level device, well control is achieved by detecting when a sand cake is encroaching the downhole equipment. Additionally, using the method for determining a level of sand in a wellbore during operations according to embodiments herein increases efficiency of planning well or equipment remedial action and reduces costs associated with premature and unplanned equipment failure or well plug-up. Overall, continuously operating the sand level device may provide early detection of sand accumulation in a wellbore and can return the well to service faster with planning well or equipment remedial action to significantly improve the operational safety, reliability, and longevity during drilling, completion, well intervention, and workover operations.

Figure 9:
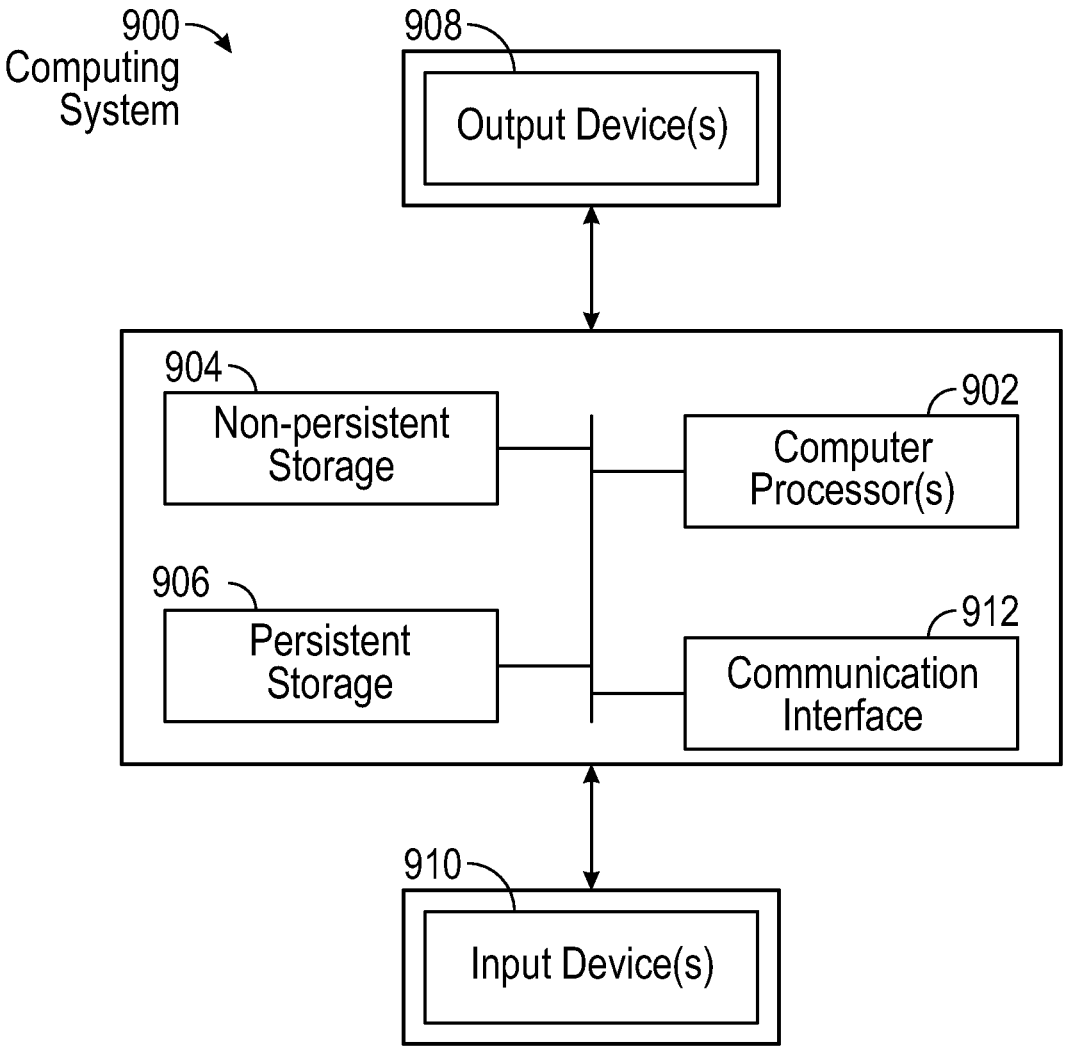
FIG. 9 is a schematic diagram of a computing system in accordance with one or more embodiments of the present disclosure.

Implementations herein for operating the artificial lift system 201 may be implemented on a computing system coupled to a controller in communication with the various components, such as the sand level device 202 of the artificial lift system 201. Any combination of mobile, desktop, server, router, switch, embedded device, or other types of hardware may be used with the artificial lift system 201. For example, as shown in FIG. 9, the computing system 900 may include one or more computer processors 902, non-persistent storage 904 (e.g., volatile memory, such as random access memory (RAM), cache memory), persistent storage 906 (e.g., a hard disk, an optical drive such as a compact disk (CD) drive or digital versatile disk (DVD) drive, a flash memory, etc.), a communication interface 912 (e.g., Bluetooth interface, infrared interface, network interface, optical interface, etc.), and numerous other elements and functionalities. It is further envisioned that software instructions in a form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. For example, the software instructions may correspond to computer readable program code that, when executed by a processor(s), is configured to perform one or more embodiments of the disclosure.

The computing system 900 may also include one or more input devices 910, such as a touchscreen, keyboard, mouse, microphone, touchpad, electronic pen, or any other type of input device. Additionally, the computing system 900 may include one or more output devices 908, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) 902, non-persistent storage 904, and persistent storage 906. Many different types of computing systems exist, and the input and output device(s) may take other forms.

The computing system 900 of FIG. 9 may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model. For example, a GUI may first obtain a notification from a software application requesting that a particular data object be presented within the GUI. Next, the GUI may determine a data object type associated with the data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the data object and render a visual representation of the data values within a display device according to the designated rules for that data object type.

Data may also be presented through various audio methods. Data may be rendered into an audio format and presented as sound through one or more speakers operably connected to a computing device. Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A well site comprising:

a wellbore extending from a well site surface to a target reservoir;

a production tubing extending into the wellbore from the well site surface, wherein the production tubing forms a flow conduit from the target reservoir to the well site surface;

a packer disposed in the production tubing;

a bottomhole assembly disposed below the packer and coupled to the production tubing, the bottomhole assembly comprising:

a pump coupled to the production tubing, the pump configured to lift well fluids to the well site surface; and a sand level device configured to detect sand below the bottomhole assembly coupled below the pump, wherein the sand level device comprises:

one or more transmitters to generate and transmit at least two signals down the wellbore; and one or more receivers to receive the at least two signals reflected from a reflecting surface in the wellbore, wherein a time duration of transmitting and receiving the at least two signals correspond to a straight-line distance between the sand level device and the reflecting surface in the wellbore, wherein the sand level device is configured to send an alarm when the straight-line distance does not surpass a predetermined threshold.

2. The well site system of claim 1, wherein the sand level device is directly coupled to a monitoring sub attached to a bottom of the pump.

3. The well site system of claim 2, wherein the sand level device receives operating power from a cable electrically connected to the monitoring sub and to the well site surface.

4. The well site system of claim 2, wherein the sand level device is positioned at a lower most position of the production tubing at a set depth.

5. The well site of claim 1, wherein the sand level device is within a monitoring sub attached to a bottom of the pump.

6. The well site of claim 1, wherein the reflecting surface is a top surface of a sand accumulation permeated in the wellbore.

7. The well site of claim 6, wherein the predetermined threshold is a maximum level of the sand accumulation before contacting the sand level device.

8. The well site of claim 1, wherein the at least two signals comprise a first signal, a second signal, and a third signal, and wherein:

the first signal is transmitted at a first angle to reflect on a first point on the reflecting surface, the second signal is transmitted at a second angle to reflect on a second point on the reflecting surface, the third signal is transmitted at a third angle to reflect on a third point on the reflecting surface, and wherein the first angle, the second angle, and the third angle are different.

9. A method comprising:

pumping well fluids, with a pump, up a production tubing in a wellbore extending from a well site surface to a target reservoir, from the target reservoir to the well site surface, wherein the production tubing forms a flow conduit from the target reservoir to the well site surface; and wherein a packer is disposed in the production tubing;

wherein a bottomhole assembly comprising the pump is disposed below the packer and coupled to the production tubing;

transmitting, with one or more transmitters of a sand level device configured to detect sand below the bottomhole assembly, at least two signals down the wellbore;

reflecting the at least two signals off a wall in the wellbore;

receiving the at least two signals, with one or more receivers of the sand level device;

determining a straight-line wall distance from the sand level device to the wall in the wellbore based on a time duration of transmitting and receiving the at least two signals;

storing the determined straight-line wall distance to form a stored wall distance in a memory of the sand level device;

reflecting the at least two signals off a reflecting surface in the wellbore;

receiving the at least two signals;

determining a reflected distance from the sand level device to the reflecting surface, determining a difference between the stored wall distance and the reflected distance, and comparing, using a processor of the sand level device, the difference to a predetermined threshold, wherein, when the difference does not surpass the predetermined threshold, the method comprises:

sending an alarm indicating that a sand level accumulation in the wellbore has reached a maximum level; and conducting remedial operations to reduce the sand level accumulation.

10. The method of claim 9, further comprising powering the sand level device with a cable running from the well site surface down into the wellbore and operatively coupled the sand level device.

11. The method of claim 10, further comprising transmitting the time duration of transmitting and receiving the at least two signals to the well site surface via the cable.

12. The method of claim 9, further comprising continuously transmitting and receiving the at least two signals to provide a real-time measurement of the sand level accumulation, and wherein the continuously transmitting and the receiving further comprise:

transmitting a first signal at a first angle to reflect on a first point on the reflecting surface, transmitting a second signal at a second angle to reflect on a second point on the reflecting surface, transmitting a third signal at a third angle to reflect on a third point on the reflecting surface, wherein the first angle, the second angle, and the third angle are different, reflecting the first signal from the first point for reception by the one or more receivers, reflecting the second signal from the second point for reception by the one or more receivers, and reflecting the third signal from the third point for reception by the one or more receivers.

13. The method of claim 9, further comprising permeating sand particles into the wall in the wellbore to form the sand level accumulation.

14. The method of claim 9, wherein conducting the remedial operations comprises pumping chemically treated fluids to dissolve the sand level accumulation.

15. The method of claim 14, further comprising:

continuously transmitting and receiving the at least two signals during the remedial operations; and determining an amount of the sand level accumulation being dissolved.

16. The method of claim 15, further comprising stopping the remedial operations once the determined straight-line distance surpasses the predetermined threshold.

17. A non-transitory computer readable medium storing instructions on a memory coupled to a processor, the instructions comprising functionality for:

transmitting, with one or more transmitters of a sand level device configured to detect sand below a bottomhole assembly, at least two signals down a wellbore;

wherein the bottomhole assembly comprises a pump;

wherein the bottomhole assembly is disposed below a packer and is coupled to production tubing extending from a well site surface to a target reservoir;

wherein the pump is configured to lift well fluids to the well site surface;

reflecting the at least two signals off a reflecting surface in the wellbore; and receiving the at least two signals, with one or more receivers of the sand level device;

wherein the processor is configured for:

determining a straight-line distance from the sand level device to the reflecting surface in the wellbore based on a time duration of transmitting and receiving the at least two signals; and comparing the determined straight-line distance to a predetermined threshold.

18. The non-transitory computer readable medium of claim 17, wherein the instructions further comprise functionality for:

transmitting each signal of the at least two signals at different angles; and reflecting each signal of the at least two signals off different points on the reflecting surface.

19. The non-transitory computer readable medium of claim 17, wherein the instructions further comprise functionality for:

sending an alert if the determined straight-line distance does not surpass the predetermined threshold, wherein the predetermined threshold is a maximum allowed sand level in the wellbore.

20. The non-transitory computer readable medium of claim 17, wherein the instructions further comprise functionality for:

continuously transmitting and receiving the at least two signals to provide a real-time measurement of a sand level accumulation, and wherein the continuously transmitting and the receiving further comprise:

transmitting a first signal at a first angle to reflect on a first point on the reflecting surface, transmitting a second signal at a second angle to reflect on a second point on the reflecting surface, transmitting a third signal at a third angle to reflect on a third point on the reflecting surface, wherein the first angle, the second angle, and the third angle are different, reflecting the first signal from the first point for reception by the one or more receivers, reflecting the second signal from the second point for reception by the one or more receivers, and reflecting the third signal from the third point for reception by the one or more receivers.

* * * * *